US008675897B2

(12) United States Patent
Fukuda et al.

(10) Patent No.: US 8,675,897 B2
(45) Date of Patent: Mar. 18, 2014

(54) EAR-MUFF TYPE HEADSET FOR TWO-WAY COMMUNICATION

(75) Inventors: Mikio Fukuda, Tokyo (JP); Tomoya Atsumi, Tokyo (JP); Shouji Fujino, Tokyo (JP)

(73) Assignee: Temco Japan Co., Ltd. (JP)

( * ) Notice: Subject to any disclaimer, the term of this patent is extended or adjusted under 35 U.S.C. 154(b) by 228 days.

(21) Appl. No.: 12/996,444

(22) PCT Filed: Sep. 2, 2009

(86) PCT No.: PCT/JP2009/004319

§ 371 (c)(1),
(2), (4) Date: Dec. 6, 2010

(87) PCT Pub. No.: WO2010/026746

PCT Pub. Date: Mar. 11, 2010

(65) Prior Publication Data

US 2011/0170718 A1 Jul. 14, 2011

(30) Foreign Application Priority Data

Sep. 4, 2008 (JP) ..... 2008-227238

(51) Int. Cl.
*H04R 1/00* (2006.01)

(52) U.S. Cl.
USPC ..... 381/151; 381/74

(58) Field of Classification Search
USPC ..... 381/72, 151, 371, 74; 600/418
See application file for complete search history.

(56) References Cited

U.S. PATENT DOCUMENTS

| | | | | |
|---|---|---|---|---|
| 5,282,253 | A * | 1/1994 | Konomi | 381/151 |
| 5,970,155 | A * | 10/1999 | Leppalahti | 381/72 |
| 2002/0085733 | A1 * | 7/2002 | Cottrell | 381/371 |
| 2004/0136543 | A1 * | 7/2004 | White et al. | 381/74 |
| 2005/0197565 | A1 * | 9/2005 | Yagi et al. | 600/418 |
| 2009/0252352 | A1 * | 10/2009 | Emilsson | 381/151 |

FOREIGN PATENT DOCUMENTS

| | | |
|---|---|---|
| JP | S62-186585 | 11/1987 |
| JP | H05-50892 | 7/1993 |
| JP | 2005-151183 | 9/2005 |

* cited by examiner

*Primary Examiner* — Duc Nguyen
*Assistant Examiner* — Phan Le
(74) *Attorney, Agent, or Firm* — Schmeiser, Olsen & Watts, LLP

(57) ABSTRACT

It is an object of the invention to provide a headset for performing simultaneous two-way communication or alternate two-way communication, which has excellent sound insulating properties such that external noise is not possibly mixed even when used under high noise conditions. A pair of bowl-shaped housings 1 each having an annular pad 2 attached to the rim of an opening portion are connected together through a headband 3, an acoustic speaker 5 supported by a buffer material 4 is arranged in at least one of the housings 1, and a bone conduction microphone 6 supported by the buffer material 4 such that the distal end is brought into abutment against the ear or the portion around the ear when a user wears the headset is arranged in at least one of the housings 1.

2 Claims, 6 Drawing Sheets

EAR-MUFF TYPE HEADSET FOR TWO-WAY COMMUNICATION

TECHNICAL FIELD

The present invention relates to an ear-muff type headset for two-way communication, and more particularly, to an ear-muff type headset for two-way communication which enables simultaneous two-way communication or alternate two-way communication without being disturbed by external noise in construction sites, disaster sites, work sites, airports or the like where a person is particularly subjected to high noise levels.

BACKGROUND ART

As a conventional headset for performing simultaneous two-way communication or alternate two-way communication under high noise conditions as described above, there is often used a headset in which a pair of hermetically-sealed bowl-shaped housings 31 each having an annular pad 32 attached to the rim of an opening portion are connected together through a headband 33, an acoustic speaker 34 is arranged in at least one of the housings 31, and a close-talking boom microphone 35 that extends to the mouth is provided in one of the housings 31 (for example, FIG. 5 and Japanese Utility Model Laid-Open No. 62-186585).

Some headsets employ a bone conduction microphone 36 instead of the boom microphone 35. In this case, the bone conduction microphone 36 is embedded in a projecting portion 35 for mounting a bone conduction microphone that is formed by extending a portion of the housing 31 (see FIG. 6).

However, the headset of the type using the boom microphone 35 has a disadvantage that its performance is variable depending on a position where the boom microphone 35 is set and the headset cannot be used in an environment in which an operator needs to wear a mask. Also, the headset of the type using the bone conduction microphone 36 has a disadvantage that external noise is easily mixed since the projecting portion 35 for mounting a bone conduction microphone is located outside the annular pad 32 having sound insulating properties.

Patent Document 1: Japanese Utility Model Laid-Open No. 62-186585

DISCLOSURE OF THE INVENTION

Problems to be Solved by the Invention

As described above, among the conventional headsets for performing simultaneous two-way communication or alternate two-way communication, the headset of the type using the boom microphone has a disadvantage that its performance is variable depending on a position where the boom microphone is set and the headset cannot be used in an environment in which an operator needs to wear a mask. Also, the headset of the type using the bone conduction microphone has a disadvantage that it is vulnerable to external noise since the projecting portion for mounting a bone conduction microphone is located outside the annular pad having sound insulating properties. Both the headsets have problems when used for two-way communication under high noise conditions.

The present invention has been made to solve the problems of the aforementioned conventional headset for performing simultaneous two-way communication or alternate two-way communication, and it is an object of the invention to provide a headset for performing simultaneous two-way communication or alternate two-way communication, which has excellent sound insulating properties such that external noise is not possibly mixed even when used under high noise conditions.

Means for Solving the Problems

In order to achieve the above object, the invention according to claim 1 is an ear-muff type headset for two-way communication, wherein a pair of bowl-shaped housings each having an annular pad attached to a rim of an opening portion are connected together through a headband, an acoustic speaker supported by a buffer material is arranged in at least one of the housings, and a bone conduction microphone supported by the buffer material such that a distal end is brought into abutment against an ear or a portion around the ear when a user wears the headset is arranged in at least one of the housings.

Preferably, the bone conduction microphone is supported in a direction perpendicular to an opening surface of the housing in an extensible and retractable manner. The headset includes a support base formed on an inner bottom surface of the housing, an outer tube supported by the support base to slide within a circular hole formed in the buffer material, a spring or another elastic body interposed between the support base and the outer tube to act to restore the outer tube to an original position, and an inner tube fitted within an end portion of the outer tube as a configuration to allow the bone conduction microphone to be extensible and retractable, wherein the bone conduction microphone is held so as to be exposed from a distal end portion of the inner tube through an anti-vibration weight mounted within the outer tube and an elastic member fixed thereto.

In order to achieve the above object, the invention according to claim 4 is an ear-muff type headset for two-way communication, wherein a pair of bowl-shaped housings each having an annular pad attached to a rim of an opening portion are connected together through a headband, a bone conduction speaker supported by a buffer material such that a distal end is brought into abutment against an ear or a portion around the ear when a user wears the headset is arranged in at least one of the housings, and a bone conduction microphone supported by the buffer material such that a distal end is brought into abutment against the ear or the portion around the ear when the user wears the headset is arranged in at least one of the housings.

Preferably, the bone conduction speaker and/or the bone conduction microphone are/is supported in a direction perpendicular to an opening surface of the housing in an extensible and retractable manner. The headset includes a support base formed on an inner bottom surface of the housing, an outer tube supported by the support base to slide within a circular hole formed in the buffer material, a spring or another elastic body interposed between the support base and the outer tube to act to restore the outer tube to an original position, and an inner tube fitted within an end portion of the outer tube as a configuration to allow the bone conduction microphone to be extensible and retractable, wherein the bone conduction microphone is held so as to be exposed from a distal end portion of the inner tube through an anti-vibration weight mounted within the outer tube and an elastic member fixed thereto.

Advantages of the Invention

In the present invention, the bone conduction microphone that is difficult to affect by eternal noise is used as a microphone, and the bone conduction microphone is mounted within the housing inside the annular pad having sound insulating properties as described above. Therefore, even when the headset is used under high noise conditions, external noise is not possibly mixed, and excellent sound insulating properties are exerted. Accordingly, simultaneous two-way communication or alternate two-way communication is enabled under high noise conditions.

BEST MODE FOR CARRYING OUT THE INVENTION

Preferred embodiments for carrying out the present invention will be described based on the accompanying drawings. In a headset for simultaneous two-way communication according to a first embodiment of an ear-muff type headset for two-way communication of the present invention, a pair of bowl-shaped housings 1 each having an annular pad 2 attached to the rim of an opening portion are connected together through a headband 3, an acoustic speaker 5 supported by a buffer material 4 is arranged in at least one of the housings 1, and a bone conduction microphone 6 supported by the buffer material 4 such that the distal end is brought into abutment against the ear or the portion around the ear when a user wears the headset is arranged in at least one of the housings 1 as shown in FIG. 1 (wiring is not shown). The housings 1 are swingably mounted on the end portions of the headband 3 in a similar manner to a typical headset.

Next, an internal configuration example of the housing 1 will be described in detail by reference to FIG. 2. Generally, the housing 1 is made of hard resin similar to that of a conventional headset, and is formed in a bowl shape large enough to cover the ear. The buffer material 4 is filled therein between the opening end thereof and a position slightly retracted from the opening end. The buffer material 4 is made of a material having an appropriate hardness such as foamed resin. In the embodiment shown in the drawing, a peripheral portion of the buffer material 4 is pressed by a pressing ring 7 that is fitted onto the opening end portion of the housing 1, and the annular pad 2 is fixed onto the pressing ring 7. The annular pad 2 is made of a depressible and restorable material having sound insulating properties such as foamed resin and rubber in a similar manner to the conventional headset.

The acoustic speaker 5 and the bone conduction microphone 6 are embedded in the buffer material 4. While the acoustic speaker 5 does not need to project from the buffer material 4, it is necessary for the bone conduction microphone 6 to be mounted projecting from the surface of the buffer material 4 such that the distal end is brought into abutment against an ear 21 (including the tragus and the other respective portions) or the portion around the ear when a user wears the headset.

The bone conduction microphone 6 is preferably supported on the buffer material 4 in an extensible and retractable manner. That is, when the headset is not used, the distal end of the bone conduction microphone 6 is set to a position flush with the outer surface of the annular pad 2, or a position slightly projecting or retracted therefrom (an extended state). When the headset is used, the distal end of the bone conduction microphone 6 is pushed by the ear or the portion around the ear against which the distal end is in abutment, to be thereby retracted while maintaining the abutment state.

To allow the bone conduction microphone 6 to be extensible and retractable, a support base 8 formed on the inner bottom surface of the housing 1, an outer tube 11 supported by the support base 8 to slide within a circular hole 9 that is formed in the buffer material 4, an elastic body 10 such as a spring interposed between the support base 8 and the outer tube 11 to act to restore the outer tube 11 to an original position, and an inner tube 12 fitted within an end portion of the outer tube 11 are provided as shown in FIG. 2, for example. In this case, the bone conduction microphone 6 is held so as to be exposed from a distal end portion of the inner tube 12 through an anti-vibration weight 13 mounted within the outer tube 11 and an elastic member 14 fixed thereto. At this point, the distal end of the bone conduction microphone 6 is set to the position flush with the outer surface of the annular pad 2, or the position slightly projecting or retracted therefrom.

When the headset having the aforementioned configuration is used, the housings 1 are lightly pressed against the side portions of the head due to the elasticity of the headband 3, and the annular pads 2 are slightly depressed. As a result, the distal end portion of the bone conduction microphone 6 is brought into abutment against the ear 21 or the portion around the ear. The distal end portion of the bone conduction microphone 6 is thereby pushed by the reaction from the abutment portion, and the elastic body 10 is compressed. Accordingly, the bone conduction microphone 6 is displaced inward to keep abutting against the ear 21 or the portion around the ear with an appropriate contact pressure and thereby maintain a usable state (see FIG. 3). At this point, the acoustic speaker 5 is located at a position corresponding to the acoustic pore, and is used in a manner similar to that in the conventional case.

The extensible and retractable structure is employed for the bone conduction microphone 6 since the bone conduction microphone 6 is easily fitted to the skin of a user wearing the headset, and the pick-up of unnecessary vibrations can be reduced. That is, when the headset is used under high noise conditions, the housing 1 itself may be vibrated and the bone conduction microphone 6 may pick up the vibrations. However, since the bone conduction microphone 6 employs the extensible and retractable structure through the elastic body 10, the anti-vibration weight 13 and the elastic member 14 as described above, the bone conduction microphone 6 does not possibly pick up the vibrations of the housing 1 itself.

Although two examples of the abutment position of the bone conduction microphone 6 are shown in FIG. 3, the abutment position of the bone conduction microphone 6 is one of the two positions, not both of them. In the case of the present embodiment, the problem of acoustic feedback that may occur in simultaneous two-way communication using a speaker and a microphone arranged within the same housing is solved by the combination of the acoustic (air-conduction) speaker 5 as the speaker and the bone conduction microphone 6.

In a headset for alternate two-way communication according to a second embodiment of an ear-muff type headset for two-way communication of the present invention, a pair of bowl-shaped housings 1 each having an annular pad 2 with sound insulating properties attached to a rim portion are connected together through a headband 3, a bone conduction speaker 15 supported by a buffer material 4 such that the distal end is brought into abutment against an ear 21 or the portion around the ear when a user wears the headset is arranged in at least one of the housings 1, and a bone conduction microphone 6 supported by the buffer material 4 such that the distal end is brought into abutment against the ear 21 or the portion around the ear when a user wears the headset is arranged in at least one of the housings 1.

The bone conduction microphone 6 according to the second embodiment has the same configuration as that of the aforementioned first embodiment, and is similarly mounted. The bone conduction speaker 15 preferably has the same extensible and retractable structure as that of the bone conduction microphone 6, and is similarly mounted. In this case, both the bone conduction microphone 6 and the bone conduction speaker 15 are brought into abutment against the ear 21 or the portion around the ear (see FIG. 4). Preferably, the bone conduction speaker 15 is arranged so as to abut against a tragus 20, and the bone conduction microphone 6 is arranged so as to abut against a position apart from the bone conduction speaker 15, for example. Although FIG. 4 shows two examples of the abutment position of the bone conduction microphone 6, the abutment position of the bone conduction microphone 6 is one of the two positions, which is apart from the bone conduction speaker 15.

In the case of the present embodiment, although the simultaneous two-way communication is difficult to achieve, alternate two-way communication is enabled under high noise conditions particularly by putting a noise-isolating plug in the acoustic pore since the headset is of ear muff type.

In both the embodiments described above, the bone conduction microphone 6 that is difficult to affect by external noise is used as the microphone, and the ear muff structure in which the bone conduction microphone 6 is mounted within the housing 1 inside the annular pad 2 having sound insulating properties is employed. Accordingly, the preferable headset for performing simultaneous two-way communication or alternate two-way communication under high noise conditions, which has excellent sound insulating properties such that external noise is not possibly mixed even when used under high noise conditions can be obtained.

The present invention has been described in detail to an extent by reference to the most preferred embodiments. However, as many apparently widely different embodiments of the present invention may be made without departing from the spirit and scope thereof, it is to be understood that the invention is not limited to the specific embodiments thereof except as defined in the appended claims.

Figure 1:
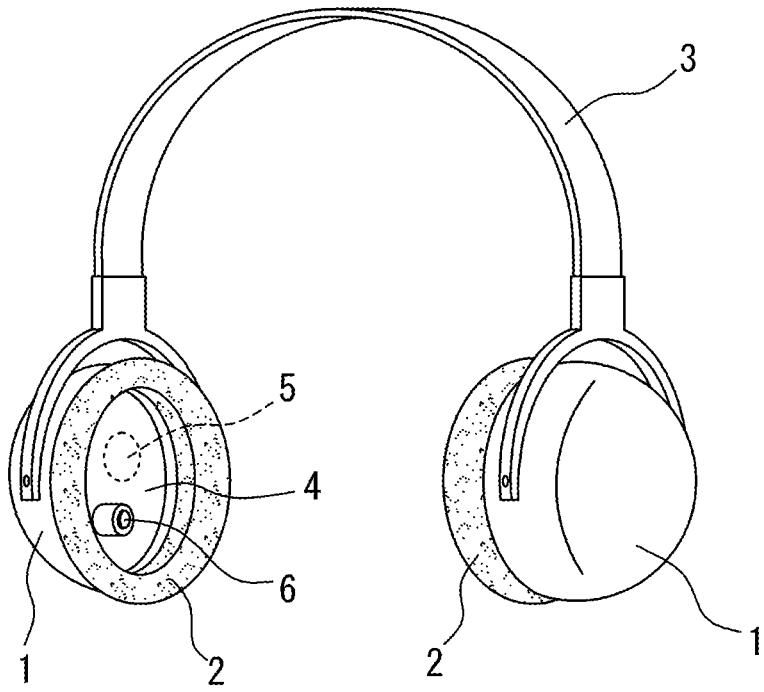
FIG. 1 is a perspective view of a headset for two-way communication according to a first embodiment of the present invention.
Figure 2:
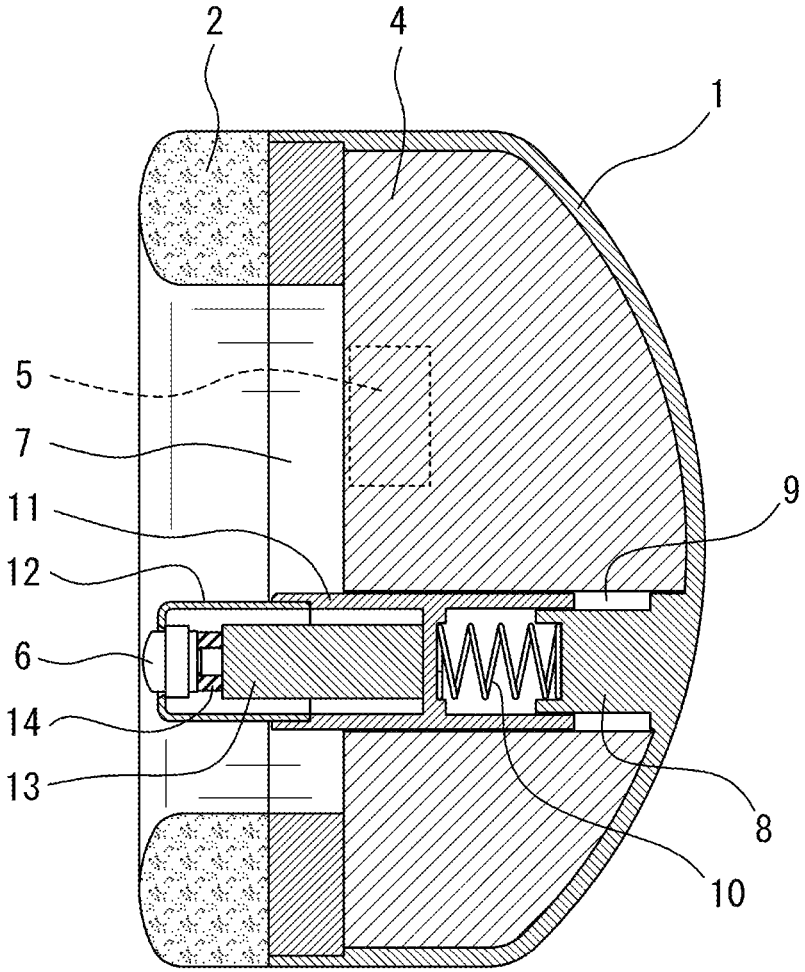
FIG. 2 is a vertical sectional view of a main portion of the headset for two-way communication according to the first embodiment of the present invention.
Figure 3:
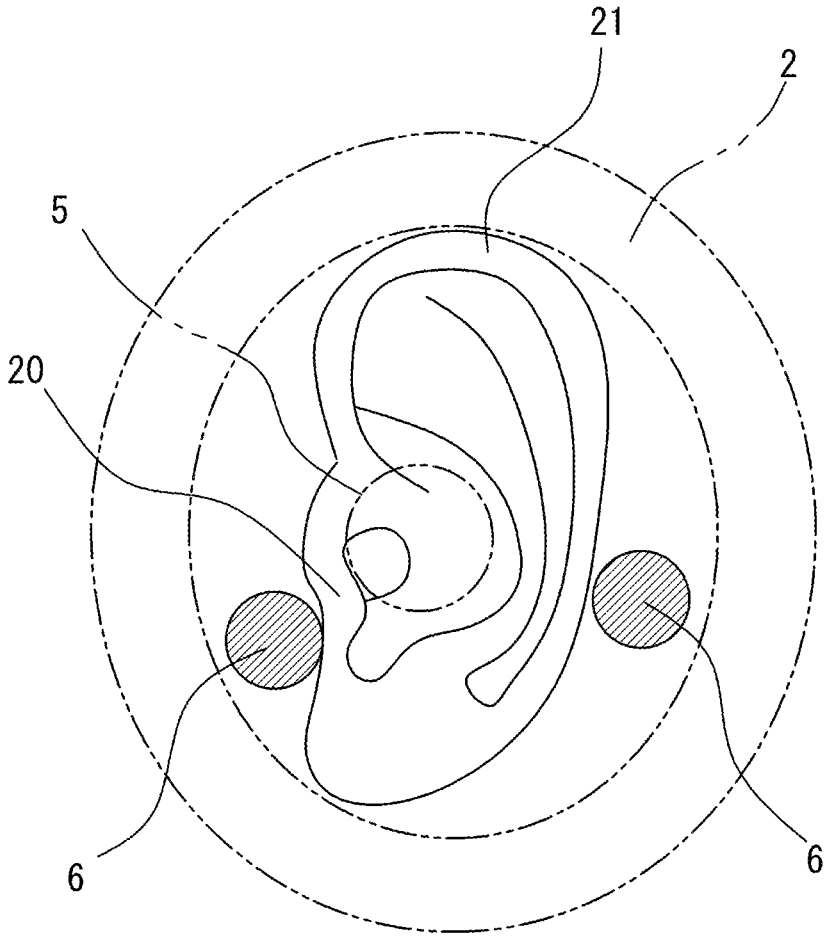
FIG. 3 is a view illustrating a use state of the headset for two-way communication according to the first embodiment of the present invention.
Figure 4:
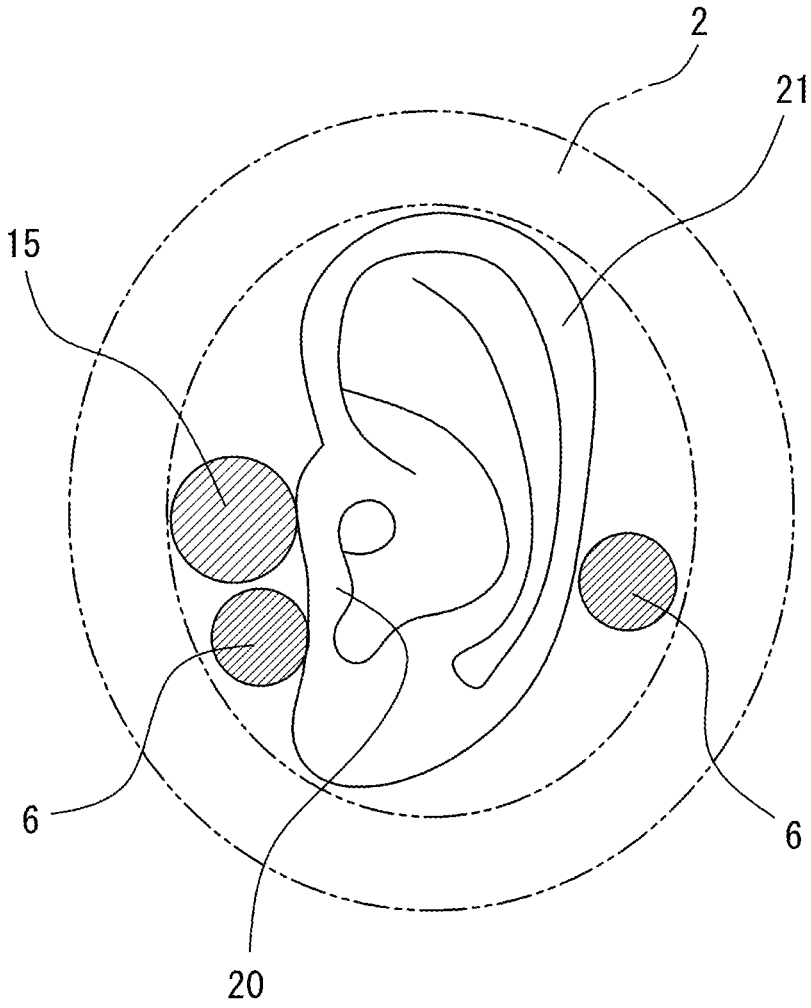
FIG. 4 is a view illustrating a use state of a headset for two-way communication according to a second embodiment of the present invention.
Figure 5:
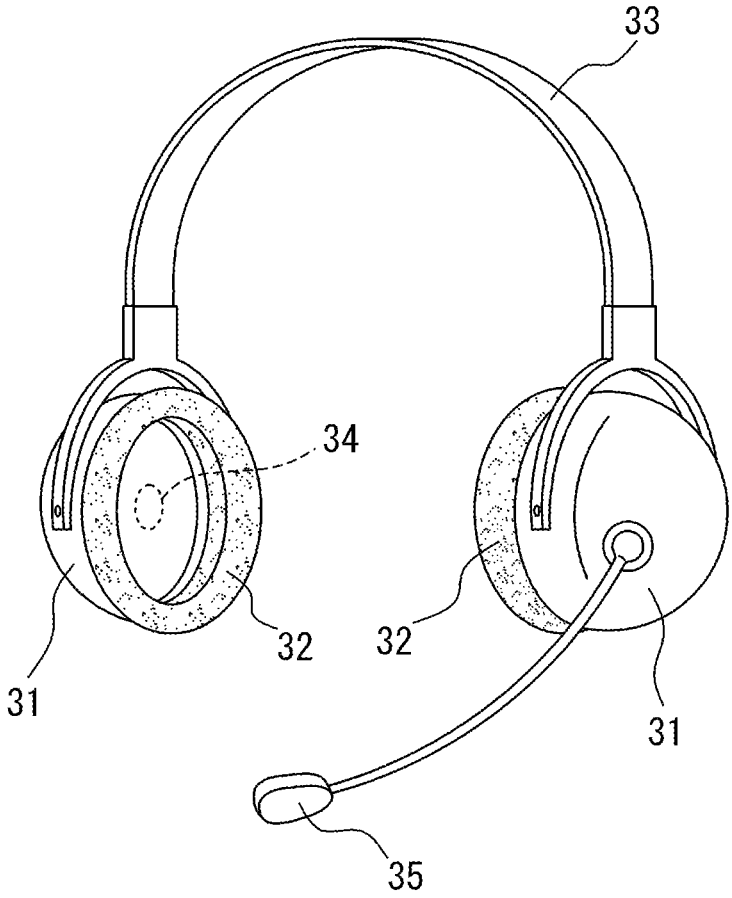
FIG. 5 is a perspective view illustrating an example of a conventional headset for two-way communication.
Figure 6:
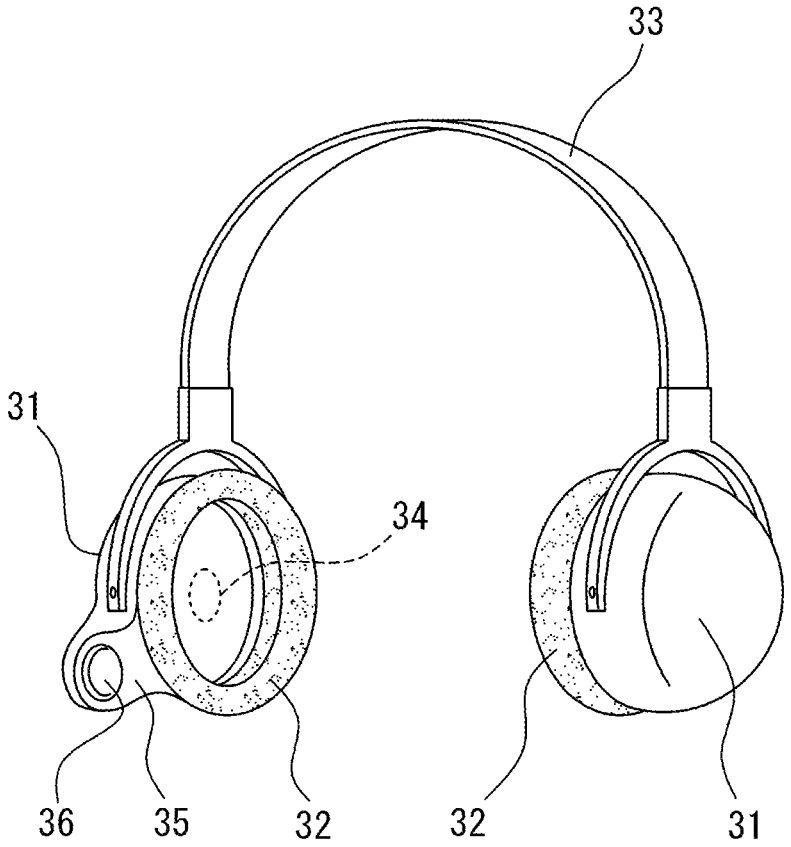
FIG. 6 is a perspective view illustrating another example of a conventional headset for two-way communication.

The invention claimed is:

1. An ear-muff type headset for two-way communication comprising:

a pair of bowl-shaped housings each having an annular pad attached to a rim of an opening portion connected together through a headband;

an acoustic speaker supported by a buffer material arranged in at least one of the pair of bowl-shaped housings; and a bone conduction microphone supported by the buffer material such that a distal end thereof is brought into abutment against at least one of an ear and a portion around the ear upon a user wearing the headset, wherein the bone conduction microphone is provided in at least one of the pair of bowl-shaped housings;

wherein the bone conduction microphone is supported so as to be extensible toward and retractable away from an opening surface of at least one of the pair of bowl-shaped housings;

wherein at least one of the pair of bowl-shaped housings include a support base formed on an inner bottom surface of the at least one of the pair of bowl-shaped housings, an outer tube supported by the support base to slide within a circular hole formed in the buffer material, an elastic body interposed between the support base and the outer tube to act to restore the outer tube to an original position, and an inner tube fitted within an end portion of the outer tube;

wherein the bone conduction microphone is held so as to be exposed from a distal end portion of the inner tube through an anti-vibration weight mounted within the outer tube and an elastic member fixed thereto.

2. An ear-muff type headset for two-way communication:

a pair of bowl-shaped housings each having an annular pad attached to a rim of an opening portion, wherein the pair of bowl-shaped housings are connected to each other through a headband;

a bone conduction speaker supported by a buffer material such that a distal end thereof is brought into abutment against at least one of an ear or a portion around the ear upon a user wearing the headset, wherein the bone conduction speaker is provided in at least one of the pair of bowl-shaped housings; and a bone conduction microphone supported by the buffer material such that a distal end thereof is brought into abutment against at least one of the ear or the portion around the ear upon the user wearing the headset, wherein the bone conduction microphone is provided in at least one of the housings;

wherein the bone conduction microphone and bone conduction speaker are supported so as to be extensible toward and retractable away from an opening surface of at least one of the pair of bowl-shaped housings;

wherein at least one of the pair of bowl-shaped housings include a support base formed on an inner bottom surface of the at least one of the pair of bowl-shaped housings, an outer tube supported by the support base to slide within a circular hole formed in the buffer material, an elastic body interposed between the support base and the outer tube to act to restore the outer tube to an original position, and an inner tube fitted within an end portion of the outer tube;

wherein the bone conduction microphone is held so as to be exposed from a distal end portion of the inner tube through an anti-vibration weight mounted within the outer tube and an elastic member fixed thereto.

* * * * *